United States Patent [19]

Dunn

[11] Patent Number: 4,692,949

[45] Date of Patent: Sep. 15, 1987

[54] HIGH-HEAD, LOW-VOLUME SURFING WAVE POOL

[75] Inventor: George W. Dunn, Chula Vista, Calif.

[73] Assignee: WaveTek International, Inc., Mansfield, Ohio

[21] Appl. No.: 897,149

[22] Filed: Aug. 15, 1986

Related U.S. Application Data

[63] Continuation of Ser. No. 807,774, Dec. 11, 1985, abandoned, which is a continuation of Ser. No. 612,743, May 21, 1984, abandoned.

[51] Int. Cl.[4] ..... A47K 3/10

[52] U.S. Cl. ..... 4/491

[58] Field of Search ..... 4/491; 405/79

[56] References Cited

U.S. PATENT DOCUMENTS 4,467,483 8/1984 Bastenhof ..... 4/491

FOREIGN PATENT DOCUMENTS 1233960 6/1971 United Kingdom ..... 4/491

*Primary Examiner*—Stephen Marcus

*Assistant Examiner*—L. J. Peters

*Attorney, Agent, or Firm*—Renner, Otto, Boisselle & Lyon

[57] ABSTRACT

A surfing wave pool assembly has a construction so that a continuous front breaking, surfing wave is established. This permits body surfers or surfboards to surf on the forward edge of this advancing wave for most of the length of a pool. The continuous wave front is established by the rapid discharge of water from an elevated reservoir into the deep end of the pool over a reef. A substantial amount of water in the entire assembly is saved by utilizing an elevated floor in the reservoir and a restricted area conduit from the elevated reservoir to openings at the deep end of the pool. The elevated reservoir establishes a sufficiently high head of water to create a surfing wave, yet the elevated floor and the restricted area conduit means substantially limit the volume of water in the assembly required to create the surfing wave. The foregoing abstract is merely a resume of one general application, is not a complete discussion of all principles of operation or applications, and is not to be construed as a limitation on the scope of the claimed subject matter.

9 Claims, 8 Drawing Figures

HIGH-HEAD, LOW-VOLUME SURFING WAVE POOL

This is a continuation of co-pending application Ser. No. 807,774 filed on Dec. 11, 1985 which is a continuation of Ser. No. 612,743 filed May 21, 1984, both applications are now abandoned.

BACKGROUND OF THE INVENTION

A number of patents have been granted on structures and methods for creating waves in an enclosed body of water such as a pool. The Schuster and Boes in U.S. Pat. No. 3,629,877, issued Dec. 28, 1971, is one which created small, mostly up and down, waves in a pool, e.g., two to three-foot high waves, so that swimmers could enjoy being bounced around on such waves, such as when floating on a small raft. A number of other patents have been suggested for generating this type of wave for amusement purposes, such as U.S. Pat. No. 3,789,612 to Richard, which used a plunger being raised and lowered. The U.S. Pat. No. 4,276,661 to Baker utilized vertically reciprocating air cushion pistons to create waves. In U.S. Pat. No. 3,005,207, the inventor Matrai suggested a gate effect swinging around a vertical pivot while under water to create such waves. In U.S. Pat. No. 3,350,724, Leigh suggested a vertically reciprocating plunger.

U.S. Pat. No. 586,983 to Wharton referred to a breaking wave, but this breaking was only after the wave reached the shore and the wave was created by a horizontally reciprocating plunger, which occupied most of the pool. A similar effect was found in U.S. Pat. No. 586,718 to Wharton, wherein he states long waves are created and are converted into breakers by the return water flowing down the inclined beach. In this case, the long waves were created by water flowing from an overhead tank. U.S. Pat. No. 2,056,855 to Herz also showed similar types of waves in a swimming pool, presumably created by alternate suction and air pressure on caissons at one end of the pool. U.S. Pat. No. 3,557,559 to Barr, showed a reciprocating plunger which moved horizontally.

Only one installation of a pool with a shoreline and a machine to create actual breaking and surfing waves is known in the United States. By a breaking surfing wave is meant one which is high enough, e.g., five or six feet in elevation, so that one may use surfboards or may body surf on the forward-breaking portion of this surfing wave. A continuous wave front is created entirely across the width of the pool and traverses the length of the pool so that persons may ride a surfboard on the wave front the length of the pool. U.S. Pat. No. 3,473,334 to Phillip Dexter shows the initial concept of this pool later constructed. Such patent contemplates the formation of a surfing wave which actually curls over or breaks on the forward edge as it moves forward along the length of the pool, as distinguished from merely breaking on the shore, as shown in the Wharton patents. In the surfing wave pool actually constructed, the construction was not as shown in the U.S. Pat. No. 3,473,334 because the vertically moving gate was found to be impractical, but instead an arcuately moving gate was used, carried on a generally horizontal beam to a pivot point considerably upstream from the gate and within the enlarged reservoir. Also, the hydraulic cylinders to swing this beam and gate were always positioned in the water in this enlarged reservoir.

Such prior surfing wave pool assembly had a number of disadvantages, including a hydraulic system which was located on a floor above the water storage tank wherein it was not easily accessible for service, and also hydraulic oil could be spilled and run into the pool water. The arcuately swung gate valves were heavy and hard to operate easily, requiring hydraulic instead of pneumatic actuators with excessive maintenance. The pool had a sand bottom which was a continuous source of maintenance. Each hydraulic operator for the gate valve operation was located in the chlorinated water at all times, including nighttime, when the pool was not in operation for swimmers. The maintenance and service on these hydraulic cylinders was very costly and timeconsuming. In order to replace a hydraulic cylinder, it was necessary to drain the pool and the stored water and it took four days to refill the pool. If this happened during the operating season, there could be a serious loss of financial revenue.

SUMMARY OF THE INVENTION

Accordingly, the problem to be solved is how to construct a breaking surfing wave suitable for surfing, and which overcomes the defects of the prior art. This problem is solved by a high head, low volume surfing wave pool assembly comprising, in combination, a water pool having a deep end and a remote end, said pool adapted to have a nominal water level and having water openings in said deep end, elevated reservoir means near said deep end of said pool, said reservoir means having a floor elevated above said nominal water level and having side walls to hold periodically a volume of water sufficient for a surfing wave in said pool, quick-opening valve means, restricted area conduit means connecting said valve means between the lower end of said reservoir means and said pool deep end water openings, return pump and conduit means to pump water from said pool to said reservoir means, filter means connected to filter the water volume in the assembly, and cyclical means connected to actuate said valve means periodically to empty at least a majority of the volume of water in said elevated reservoir means into the deep end of said pool, with said reservoir means establishing a sufficiently high head of water to create a surfing wave, yet said elevated floor and said restricted area conduit means substantially limiting the total volume of water in the assembly required to create the surfing wave.

The problem is further solved by a surfing wave pool assembly wherein the pool has first and second ends and an elevated reservoir with water communication via quick opening valve means from the reservoir to pool openings at the first end of the pool, return pump and conduit means to pump water from the pool to the reservoir, filter means connected to filter the water in the assembly, and cyclical means to actuate the valve means periodically to empty a volume of water in the elevated reservoir into the pool openings for a surfing wave in the pool, the provision of a high head, low volume assembly characterized in that said elevated reservoir has an elevated floor elevated above the nominal water level in the pool, said valve means being connected by restricted area conduit means from near the bottom of said elevated reservoir to communicate with said pool openings, said conduit means having a considerably smaller cross-sectional area in a horizontal plane than the cross-sectional area of said elevated reservoir so that said reservoir establishes a sufficiently high head of water to create a breaking wave for surfing yet the elevated floor in the reservoir and the restricted area conduit means substantially limit the total volume of water in the assembly required to create the breaking surfing waves.

Accordingly, an object of the invention is to provide a breaking surfing wave in the pool assembly wherein the volume of water required is minimized.

Another object of the invention is to provide a breaking surfing wave pool assembly wherein water stored in a reservoir has a high head for adequate pressure to make the wave, yet it utilizes a minimum volume of water.

Another object of the invention is to provide a surfing wave pool assembly wherein the water filtering and water usage requirements are minimized.

Other objects and a fuller understanding of the invention may be had by referring to the following description and claims, taken in conjunction with the accompanying drawing.

DESCRIPTION OF THE PREFERRED EMBODIMENTS

Figure 1:
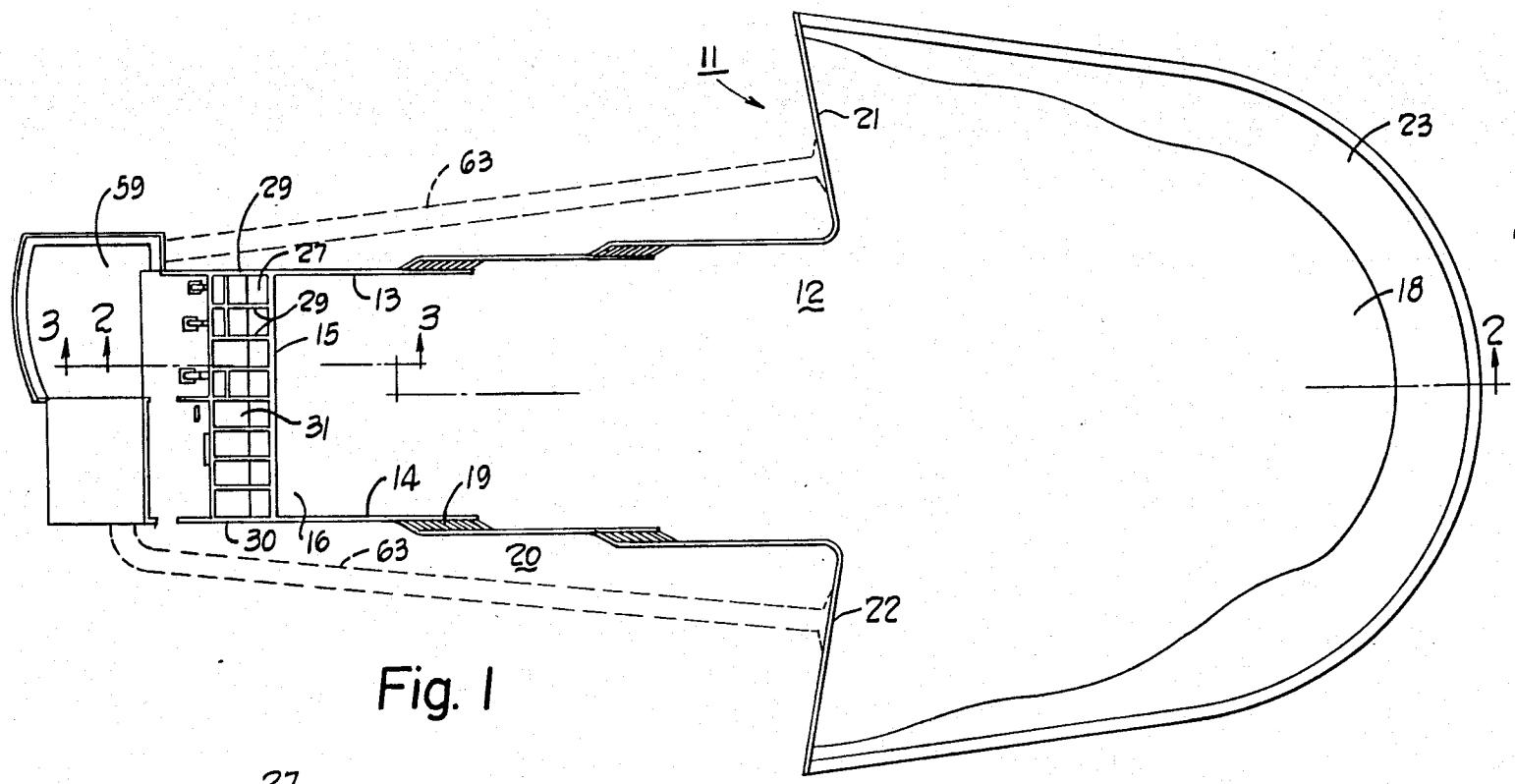
FIG. 1 is a plan view of a breaking surfing wave pool incorporating the invention.
Figure 2:
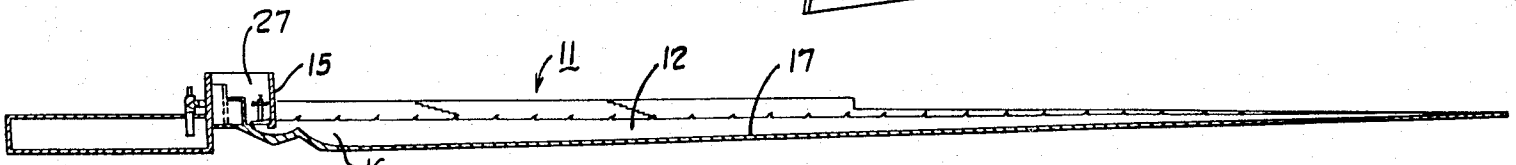
FIG. 2 is a longitudinal, sectional view on the line 2—2 of FIG. 1.
Figure 3:
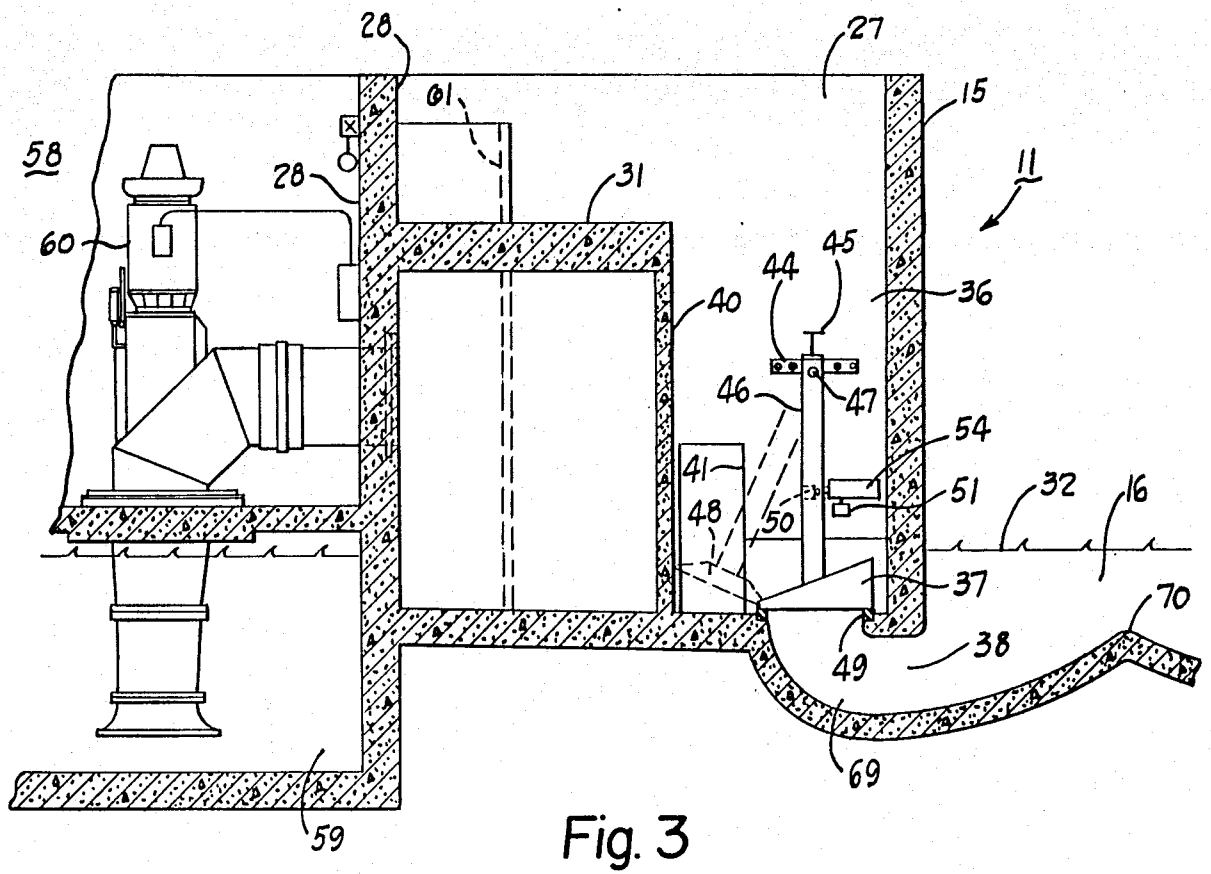
FIG. 3 is a somewhat enlarged, vertical elevational view on line 3—3 of FIG. 1.
Figure 4:
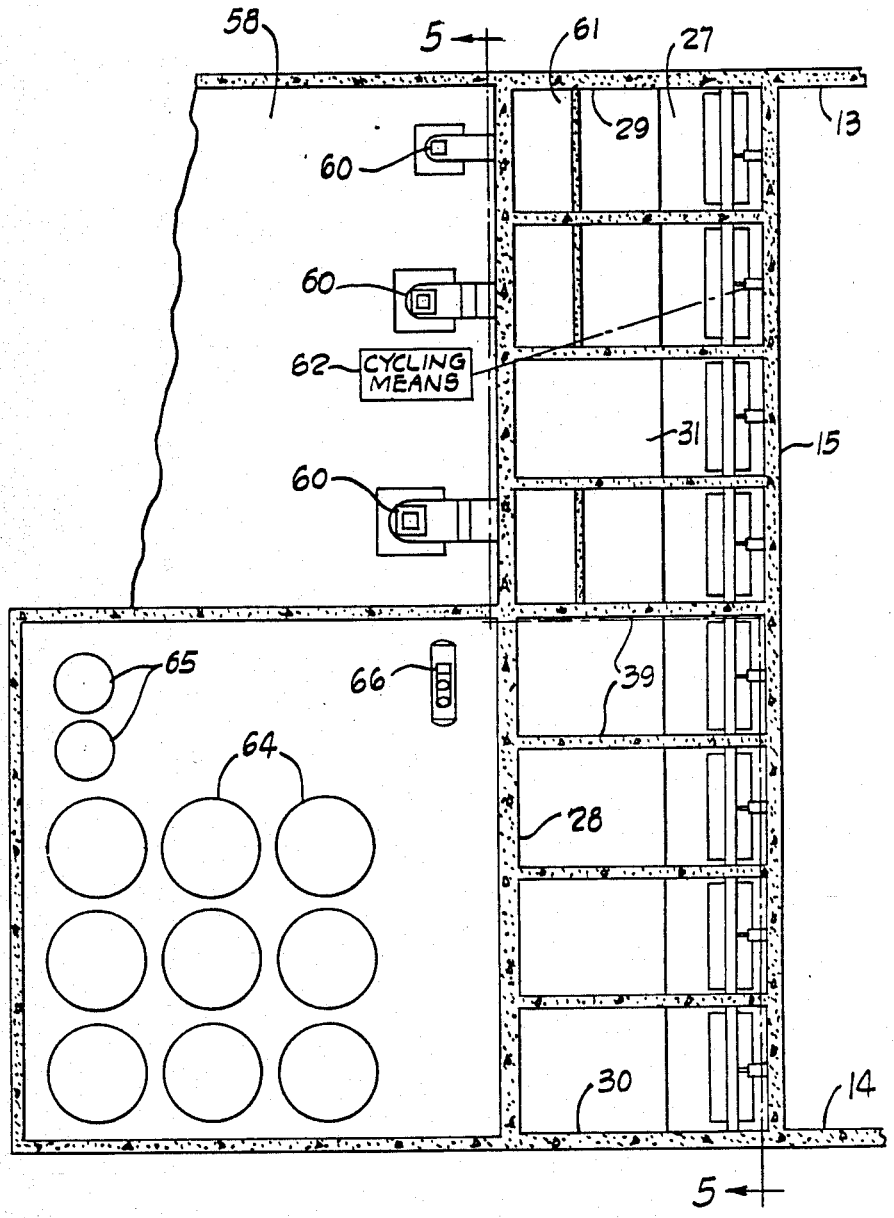
FIG. 4 is an enlarged plan view of the reservoir area of FIG. 1.
Figure 5:
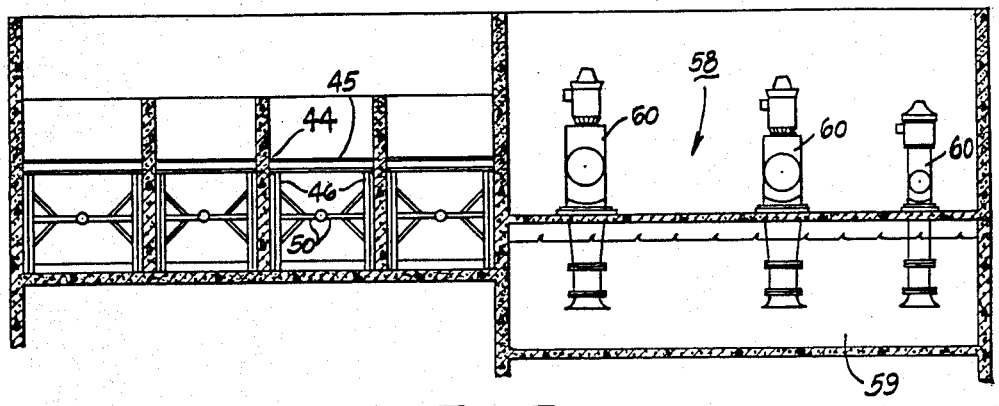
FIG. 5 is an elevational, sectional view on line 5—5 of FIG. 4.

FIGS. 1 through 5 illustrate one preferred embodiment of the present invention, wherein a high-head, low-volume surfing wave pool assembly 11 is shown. This pool assembly includes generally a water pool 12 shown in FIGS. 1 and 2 which has preferably vertical side walls 13 and 14, a vertical end wall 15 at a deep end 16, and a bottom 17 which slopes substantially uniformly from the deep end 16 to a shallow end 18. The side walls 13 and 14 have access stairways 19 from a deck area 20 down into the water of the pool. In one embodiment of the pool, the width at the deep end was 84 feet and the length of the pool was 415 feet. The length of the side walls 13 and 14 was 195 feet, and the width of the pool enlarged rapidly by wing walls 21 and 22 to end at a generally semicircular beach area 23. This beach area might be a sandy area, but preferably the bottom 17 of the pool is a hard surface, such as concrete, to prevent sand getting into the return pipes and sump.

An elevated reservoir 27 is provided at the deep end 16 of the pool 12. This reservoir is defined partly by the vertical end wall 15 at the front thereof and, additionally, has a vertical rear wall 28 and vertical side walls 29 and 30 which may be extensions of the pool side walls 13 and 14, respectively. The reservoir has an elevated floor 31 which is substantially horizontal in this embodiment of FIGS. 1-5. This elevated reservoir preferably has a height of 20 feet over the normal water level 32, and the floor 31 has a height of 14 feet over the nominal water level, so that the reservoir can store sufficient water to be rapidly discharged so that a continuous front, breaking, surfing type of wave will be established in the pool 12, traveling from the deep end 16 toward the shallow end 18.

Restricted area conduit means 36 and quick opening valve means 37 are provided and communicate the elevated reservoir 27 with the deep end 16 of the pool. To accomplish this, pool openings 38 are provided at the deep end of the pool, at the bottom of the end wall 15. For convenience in manufacture, the width of the pool, which may be 84 feet, for example, is subdivided into eight different sections by vertical interior walls 39. Each of the eight sections may be identical, so for convenience, only one will be described.

The restricted area conduits 36 are defined partly by the end wall 15 and partly by a rear wall 40. Also, two opposite interior walls 39 complete each conduit, which is rectangular in plan view. The interior walls 39 may have access doorways 41 for servicing.

Each of the valves 37 is a swing valve or gate valve fabricated from structural steel parts. Pivot beam supports 44 are mounted on the interior walls 39 and a beam 45 is mounted on such supports. Depending struts 46 are pivoted at 47 from the beam 45. A valve plate 48 is dependently carried by the struts 46 and cooperates with a valve seat 49, with a gasket therebetween, so that this valve plate is a movable member of a valve to be closed against the valve seat 49. A cross-beam 50 is mounted on the depending struts 46, and a fixed beam 51 extends between adjacent interior walls 39. Power means 54 is provided to actuate the valve 48-49, and this power means is shown as a fluid cylinder mounted on the fixed beam 51 and having a piston rod acting on the cross-beam 50. When the fluid cylinder 54 is energized in one direction, the valve 37 is moved to the open position shown in dotted lines in FIG. 3. When it is actuated in the opposite direction, it is moved to a closed condition.

A control room 58 is provided at the deep end of the pool, and conveniently this may be over a water sump 59. Vertical axis direct motor-driven pumps 60 are mounted in the control room and pump water from the sump 59 up through standpipes 61 into the elevated reservoir 27. In one embodiment, these may be 100, 200, and 300 H.P. motor-driven pumps, which may be operated in various combinations to give different rates of fill of the reservoir 27, and hence different cycle times for producing the breaking surfing waves. Cycling means 62 is diagrammatically shown as controlling the fluid cylinders 54 for cyclic actuation of these quick opening valves 37. Large return pipes 63 return water by gravity from near the shallow end of the pool to the sump 59. The control room 58 also includes water filters 64 which are supplied by a filter pump 65 and return water to the sump 59. The filter pump and filters are sized to provide the desired filtering rate, e.g., to filter all of the water in the pool assembly in four or six hours.

The exit end of the quick opening valve 37 is connected by a curved conduit 69 to the pool openings 38, which in turn may be protected by a grating, so that persons in the pool will not be endangered by any mechanism. After the water passes out of the pool opening 38, it is directed forwardly and upwardly by means of a weir or reef 70, and thus establishes the breaking, surfing wave which may be four to six feet above the nominal water level and be in a continuous front across the width of the pool.

Figure 6:
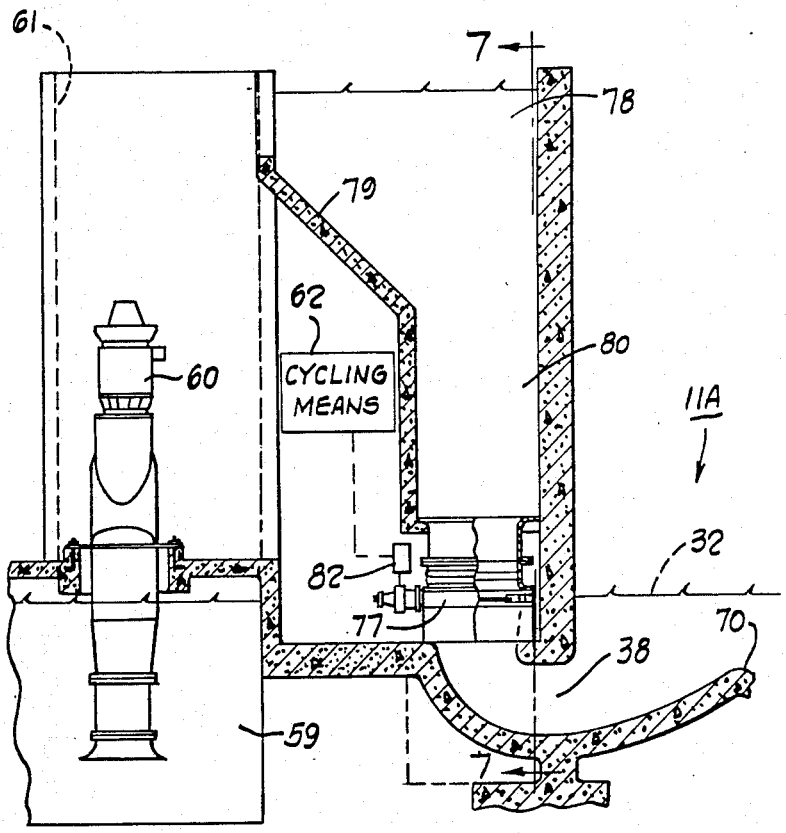
FIG. 6 is an enlarged, elevational view similar to FIG. 3, but showing a modification of the valves.
Figure 7:
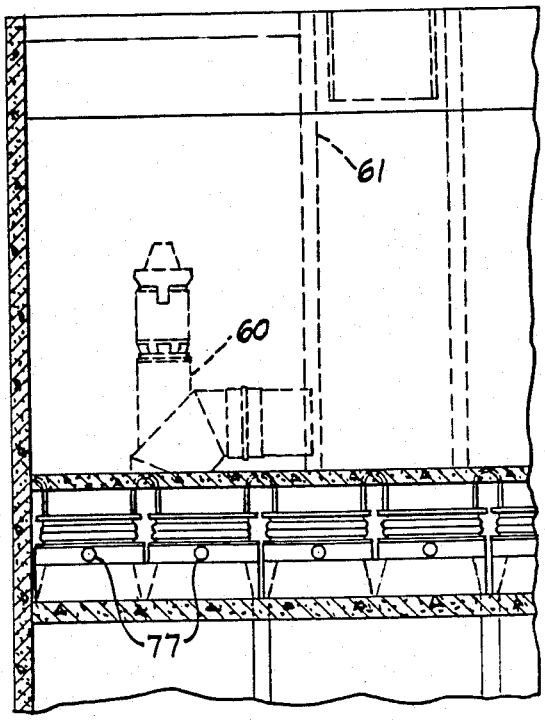
FIG. 7 is a sectional view on line 7—7 of FIG. 6.
Figure 8:
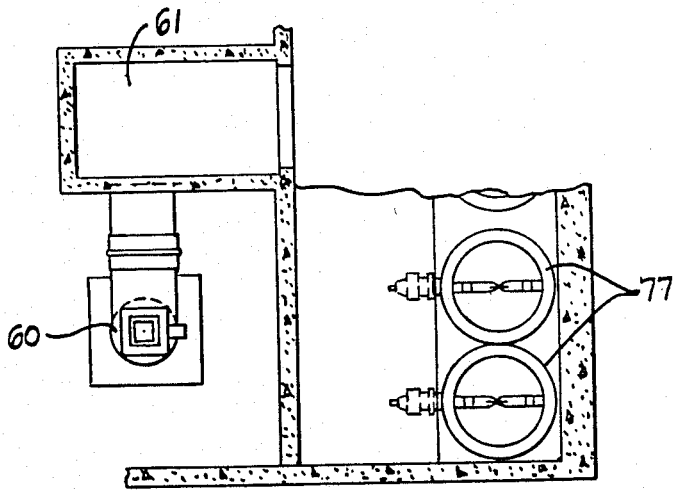
FIG. 8 is a partial plan view of the modified valve system shown in FIG. 6.

FIGS. 6 and 7, and 8 illustrate a modified form of the invention. Again, quick opening valves 77 are utilized—in this case, butterfly vavles. In this pool assembly 11A an elevated reservoir 78 is provided, and in this case it has an elevated floor 79 which is sloping, e.g., at a 45-degree angle to the horizontal. By means of this sloping floor, the upper part of the reservoir 78 is sufficiently large to store a volume of water, which will create a breaking surfing wave. Restricted area conduit means 80 connects the lower end of the elevator reservoir 78 with the inlet to the butterfly valves 77, and the outlets connected to the pool openings 38. The nominal water level 32 is at the level of the butterfly valves 77. A similar water pumping arrangement is utilized, with one of the water pumps 60 being shown to pump water from the sump 59 by means of the standpipe 61 to the elevated reservoir 78. The cycling means 62 is connected to control the actuation of the fluid cylinders 82 to actuate the butterfly valves through 90 degrees between open and closed conditions. There may be a plurality, such as 16, of these butterfly valves across the deep end of the pool. Again, the pool assembly 11A will have return conduit means 63 and have filters and filter pumps as in the embodiment of FIGS. 1–5.

OPERATION

The cycling means 62 will have timer means and also water depth means to determine the proper head of water in the elevated reservoir 27 or 78, when the cycling means actuates the power means 54 or 82, the quick opening valves 37 or 77 may be completely opened to discharge a large volume of water from the elevated reservoir 27 or 78 up over the reef 70 into the deep end of the pool 12. It has been determined that the entire volume of water in the reservoir need not be emptied in order to create a breaking surfing wave suitable for body surfing or surfboarding on the forward edge of the advancing wave. With a head of about 16 to 22 feet, and large enough valves and conduits for the water so that sufficient flow is obtained, it has been found that a satisfactory surfing wave may be achieved. In the embodiments of FIGS. 1–5, a drop in water level of about five feet will discharge sufficient water for the surfing wave. In a pool of 84-foot width, this is a discharge of about 60,000 to 65,000 gallons of water, and all of this occurs in about two to three seconds. This is at a rate of 714 to 773 gallons per foot of width per three seconds. To achieve this rate, the valves 27 are about 3½ feet by 9 feet. There are eight such valves. In the embodiment of FIGS. 6–8, there are 16 butterfly valves, each 4 feet in diameter. In FIGS. 1–5, air-operated cylinders are preferred, operated by air from an air compressor 66, and these valves open in about 0.15 second and close in about 0.08 second. These fluid cylinders are under water in the restricted area conduit means 36 while the pool is cycling, but when the pool is not cycling, these fluid cylinders can be out of water. This may be during the night when the pumps 60 have been shut off and the nominal water level 32 has drained from the elevator reservoir into the pool 12 and sump 59. The fact that these cylinders are not immersed at this time aids in any required servicing. Also, since they are air-operated, there is no leakage of hydraulic fluids to contaminate the pool water.

In the embodiments of FIGS. 6–8, the fluid cylinders 82 may be hydraulic cylinders because they are in a dry room, and in any event may be positioned above the axes of the butterfly valves, so that even if the control room should happen to be flooded, these fluid cylinders will be above the nominal water level. For this reason, the fluid cylinders 82 may be hydraulic fluid actuated.

TABLE 1

| Test | Head (ft.) | Water Depth Over Reef | Opening (Sec.) | Closing (Sec.) | Total Open (Sec.) | Head After Valve Close | Peak Water Velocity (ft./sec.) | Wave Height at: Reef | Mid-Channel | End of Channel | Side Wall Angle o |
|---|---|---|---|---|---|---|---|---|---|---|---|
| 9 | 18 | 3.0 | .15 | .08 | 8.2 | 1.5 | 18.3 | 4.5 | 4.25 | 4.0 | 90 |
| 10 | 14.5 | 2.5 | .17 | .08 | 8.4 | 1.0 | 14.98 | 4.5+ | 4.5 | 4.5 | 90 |
| 21 | 15.25 | 2.25 | .17 | .07 | 5.4 | 1.0 | — | 4.25 | 4.0 | 4.0 | 70 |
| 22 | 15.25 | 2.25 | .17 | .08 | 8.6 | 1.0 | 16.78 | 4.50 | 4.25 | 4.0 | 70 |
| 23 | 15.25 | 2.25 | .17 | .08 | 11.2 | 0.75 | 16.78 | 4.50 | 4.25 | 4.0 | 70 |
| 26 | 17.50 | 2.5 | .15 | .08 | 8.0 | 3.0 | 18.3 | 5.25 | 5.0 | 4.75 | 70 |
| 29 | 17.25 | 2.25 | .14 | .07 | 8.0 | 2.0 | 18.3 | 5.0 | 4.5 | 4.25 | 70 |
| 30 | 13.25 | 2.25 | .14 | .07 | 8.0 | 3.0 | 15.92 | 4.0 | 4.0 | 4.0 | 70 |

TABLE 2

| Test | Head (ft.) | Water Depth Over Reef | Opening (Sec.) | Closing (Sec.) | Total Open (Sec.) | Head After Valve Close | Peak Water Velocity (ft./sec.) | Wave Height at: Reef | Mid-Channel | End of Channel | Side Wall Angle o |
|---|---|---|---|---|---|---|---|---|---|---|---|
| 51 | 16.0 | 3.0 | .15 | .08 | 2.32 | 10.5 | — | 4.75 | 4.50 | 4.25 | 70 |
| 52 | 16.0 | 3.0 | .15 | .08 | 3.11 | 9.0 | — | 5.25 | 4.75 | 4.50 | 70 |
| 51A | 16.0 | 3.0 | .14 | .08 | 2.35 | 11.5 | 13.39 | 3.75 | 3.50 | 3.50 | 70 |
| 53 | 16.0 | 3.0 | .14 | .08 | 2.35 | 11.5 | 14.98 | 3.75+ | 3.50+ | 3.50 | 70 |
| 61 | 14.0 | | | | 2.6 | 9.5 | | 5.0 | | 4.0 | 90 |
| 62 | 15.0 | | | | 2.6 | 10.5 | | 4.0+ | | 4.0 | 90 |
| 63 | 16.0 | | | | 2.6 | 11.5 | | 4.5 | | 4.0+ | 90 |
| 64 | 17.0 | | | | 2.6 | 13.5 | | 5.0 | | 3.0 | 90 |
| 65 | 17.0 | | | | 3.0 | 12.5 | | 5.0 | | 4.0 | 90 |
| 66 | 16.0 | | | | 3.0 | 10.5 | | 5.0+ | | 4.0 | 90 |
| 67 | 16.0 | | | | 3.5 | 9.75 | | 5.0+ | | 4.0+ | 90 |
| 68 | 14.0 | | | | 2.6 | 8.75 | | 5.0 | | 4.0 | 70 |
| 69 | 15.0 | | | | 2.6 | 9.75 | | 5.0 | | 4.0 | 70 |
| 70 | 16.0 | | | | 2.6 | 10.75 | | 5.5 | | 4.5 | 70 |
| 71 | 17.0 | | | | 2.6 | 11.75 | | 6.0 | | 4.0 | 70 |

TABLE 2-continued

| Test | Head (ft.) | Water Depth Over Reef | Opening (Sec.) | Closing (Sec.) | Total Open (Sec.) | Head After Valve Close | Peak Water Velocity (ft./sec.) | Wave Height at: Reef | Mid-Channel | End of Channel | Side Wall Angle o |
|---|---|---|---|---|---|---|---|---|---|---|---|
| 72 | 18.0 | | | | 2.6 | 12.75 | | 6.0 | | 3.5 | 70 |
| 73 | 16.0 | | | | 3.0 | 10.0 | | 5.5+ | | 4.0 | 70 |
| 74 | 16.0 | | | | 3.5 | 9.0 | | 5.75 | | 3.5 | 70 |

Tables 1 and 2 illustrate tests of the embodiment of FIGS. 1–5. These tests were done with a scale model so that various parameters could be changed. The first 30 tests, shown in Table 1, were done with a reservoir which had an elevated, horizontal floor, and the valves were kept open until the reservoir was practically empty. However, starting with test 51, shown in Table 2, the valves were closed quickly after being opened; hence, there was a considerable head of water still remaining in the reservoir. In the first 30 tests, the reservoir was generally drained completely, and this used at least twice as much water as when the valves were opened for only a short time to reduce the head of water only about 5 or 6 feet. This shows the advantage of using the elevated floor 31 or 79 to limit the total volume of water in the reservoir. This minimized the total amount of water used, and the total amount of water which must be pumped so that the next surfing wave can be generated. With about 60,000 to 65,000 gallons being discharged in about three seconds (see Tests 61 through 73), a surfing wave was generated just as high as when the entire reservoir is emptied. Utilizing 600 H.P. of pumping motors, this means a surfing wave can be generated every 45 seconds rather than having to wait two to three minutes between surfing waves. Hence, the enjoyment of the pool is greatly enhanced and the costs of operation greatly lowered.

TABLE 3

| Test | Head (ft.) | Water Depth Over Reef | Opening (Sec.) | Closing (Sec.) | Total Open (Sec.) | Peak Water Velocity (ft./sec.) | Wave Height at: Reef | Mid-Channel | End of Channel | Tank Floor o | Side Wall Angle o |
|---|---|---|---|---|---|---|---|---|---|---|---|
| 31 | 20.0 | 3.0 | .27 | .33 | 5.8 | 11.07 | 5.0 | 4.5 | 5.0 | 45 | 90 |
| 32 | 21.0 | 3.0 | .25 | .36 | 5.8 | 12.56 | 5.0+ | 4.5 | 4.5 | 45 | 90 |
| 33 | 21.5 | 3.0 | .30 | .33 | 5.3 | 12.77 | 5.0+ | 4.5 | 5.0 | 45 | 90 |
| 34 | 22.0 | 3.0 | .27 | .33 | 5.4 | 11.63 | 5.0+ | 4.5 | 4.75 | 45 | 90 |
| 35 | 20.0 | 3.0 | .27 | .36 | 3.5 | 10.86 | 4.0+ | 3.5 | 4.0+ | 45 | 90 |
| 36 | 21.0 | 3.0 | .27 | .33 | 3.5 | 11.63 | 4.5 | 4.0 | 4.0+ | 45 | 90 |
| 37 | 21.5 | 3.0 | .33 | .33 | 3.5 | 11.63 | 5.0+ | 4.5 | 4.5+ | 45 | 90 |
| 38 | 22.0 | 3.0 | .27 | .33 | 3.5 | 11.63 | 5.0+ | 5.0 | 5.0+ | 45 | 90 |
| 39 | 20.0 | 3.0 | .27 | .39 | 4.9 | 11.35 | 4.0+ | 4.0 | 4.0+ | 0 | 90 |
| 40 | 21.0 | 3.0 | .27 | .36 | 4.9 | 11.63 | 5.0 | 4.5+ | 4.5+ | 0 | 90 |
| 41 | 21.5 | 3.0 | .30 | .39 | 4.9 | 11.87 | 5.0 | 4.5 | 4.0 | 0 | 90 |
| 42 | 22.0 | 3.0 | .27 | .33 | 4.9 | 11.63 | 5.0+ | 4.5 | 4.0 | 0 | 90 |

TABLE 4

| Test | Head (ft.) | Water Depth Over Reef | Opening (Sec.) | Closing (Sec.) | Total Open (Sec.) | Peak Water Velocity (ft./sec.) | Wave Height at: Reef | Mid-Channel | End of Channel | Tank Floor o | Side Wall Angle o |
|---|---|---|---|---|---|---|---|---|---|---|---|
| 81 | 17.0 | | | | 3.5 | | 3.0 | | 2.0 | 45 | 70 |
| 82 | 18.0 | | | | 3.5 | | 3.5 | | 2.5 | 45 | 70 |
| 83 | 19.0 | | | | 3.5 | | 4.0 | | 2.5 | 45 | 70 |
| 84 | 20.0 | | | | 3.5 | | 4.0+ | | 3.0+ | 45 | 70 |
| 85 | 21.0 | | | | 3.5 | | 4.5 | | 3.5 | 45 | 70 |
| 86 | 22.0 | | | | 3.5 | | 5.0 | | 4.0 | 45 | 70 |
| 87 | 22.5 | | | | 3.5 | | 5.0+ | | 4.5+ | 45 | 70 |
| 88 | 17.0 | | | | 3.5 | | 3.0 | | 2.0 | 45 | 90 |
| 89 | 18.0 | | | | 3.5 | | 3.0+ | | 2.5+ | 45 | 90 |
| 91 | 20.0 | | | | 3.5 | | 4.0 | | 4.0− | 45 | 90 |
| 92 | 21.0 | | | | 3.5 | | 4.5 | | 4.0+ | 45 | 90 |
| 93 | 22.0 | | | | 3.5 | | 5.0+ | | 4.5 | 45 | 90 |
| 95 | 26.0 | | | | 3.5 | | 5.0+ | | 4.0 | 45 | 90 |

Tables 3 and 4 refer to the butterfly valve embodiment of FIGS. 6–8. In these tables, the tests 31–38 and 81–95 were ones wherein the reservoir had an elevated sloping floor and the entire reservoir was emptied into the pool. In tests 39 to 42, the elevated horizontal floor was utilized, but again the valves were not closed and, instead, the entire contents of the elevated reservoir were emptied into the pool to create the surfing wave. The valves being used for this test were ones which would not withstand the high inertial pressure of closing during the high velocity water flow, so the reservoir was completely emptied.

By utilizing the elevated floor in the reservoir, this reduces the total volume of water in the reservoir, and hence reduces the total volume of water in the pool assembly, which includes the sump, the return conduits, and the filter capacity. In a pool of 84-foot width and 200-foot length in the channel, plus another 200 feet of length in the flared beach end, and 8-foot depth at the deep end, this results in less water in the entire pool assembly. Specifically, this would be 149,600 gallons less water to circulate, chlorinate and filter. Also, there is a saving of 179,500 gallons less capacity in the pump sump for a total savings of 329,100 gallons. Considering a six-hour turnover rate in the filtering, the filter pumping capacity required is reduced by 914 gallons per minute, and the filters required are reduced by 91 square feet of area of filter capacity. This is a considerable savings, making the pool more economical to operate, and hence the financial break-even point for pool operation is substantially lowered.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A high head, low volume surfing wave pool comprising:

a pool for containing water at a nominal level and having a deep end and a shallow end;

at least one water inlet opening in the deep end of the pool below the nominal water level;

elevated reservoir means for containing water periodically with a water head above the nominal water level of the pool;

a conduit connecting a lower portion of the reservoir with the water inlet opening in the deep end of the pool;

the conduit including walls defining a vertical passage extending from at least ten feet above the nominal water level of the pool and with a cross-sectional area less than one-half of the maximum cross-sectional area of the reservoir;

valve means disposed in the conduit movable between open and closed positions to control the flow of water between the reservoir and the pool; and actuator means located outside the pool, conduit and reservoir for moving the valve means between the closed position in which water is retained in the reservoir and the open position in which water flows from the reservoir through the conduit into the water inlet opening to form a surfing wave in the pool, said actuator means including a hydraulic cylinder located in a dry room and above the quiescent water level of the pool.

2. A surfing pool as set forth in claim 1 wherein said valve means includes a butterfly valve.

3. A surfing wave pool as set forth in claim 2 wherein the actuator means includes connecting means extending through a wall of the conduit and connecting the actuation means and the valve means.

4. The surfing wave pool of claim 1 wherein the valve means includes a butterfly valve.

5. The surfing wave pool of claim 4 wherein the valve means is located at the nominal water level of the pool.

6. The surfing wave pool of claim 4 wherein the butterfly valve includes a fixed throat and a movable plate, the plate moving from an open position to a closed position when no more than partially submerged.

7. The surfing wavepool of claim 1 wherein said elevated reservoir means includes a substantially horizontal floor.

8. The surfing wave pool of claim 1 wherein said elevated reservoir means includes an inclined floor.

9. A surfing pool as set forth in claim 1 wherein said actuator means includes a hydraulic cylinder.

* * * * *